US009889363B1

(12) United States Patent
Myrick

(10) Patent No.: US 9,889,363 B1
(45) Date of Patent: Feb. 13, 2018

(54) POWER JUMP EXERCISE EQUIPMENT

(71) Applicant: KI-ZEN Power Systems LLC, Portsmouth, VA (US)

(72) Inventor: Karla Myrick, Portsmouth, VA (US)

(73) Assignee: KI-ZEN Power Systems LLC, Portsmouth, VA (US)

( * ) Notice: Subject to any disclaimer, the term of this patent is extended or adjusted under 35 U.S.C. 154(b) by 0 days.

(21) Appl. No.: 14/966,052

(22) Filed: Dec. 11, 2015

Related U.S. Application Data

(60) Provisional application No. 62/188,794, filed on Jul. 6, 2015.

(51) Int. Cl.
*A63B 69/00* (2006.01)
*A63B 69/20* (2006.01)

(52) U.S. Cl.
CPC ..... *A63B 69/206* (2013.01); *A63B 69/004* (2013.01)

(58) Field of Classification Search
CPC .... A63B 5/00; A63B 5/08; A63B 5/11; A63B 2025/085; A63B 21/00058; A63B 21/00061; A63B 21/00065; A63B 21/00178; A63B 21/00181; A63B 21/00185; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/062; A63B 21/0626; A63B 21/0628; A63B 21/068; A63B 21/08; A63B 21/16; A63B 21/1681; A63B 21/4033; A63B 21/4034; A63B 21/4045; A63B 23/03575; A63B 23/04; A63B 23/0405; A63B 23/0482; A63B 23/0494; A63B 23/08; A63B 23/12; A63B 23/1209; A63B 23/1245; A63B 23/1281; A63B 23/14; A63B 2023/0411;

(Continued)

(56) References Cited

U.S. PATENT DOCUMENTS 3,411,497 A * 11/1968 Rickey ..... A61H 1/005 482/138
3,502,330 A * 3/1970 Cheftel ..... A63B 5/11 182/140

(Continued)

*Primary Examiner* — Loan H Thanh
*Assistant Examiner* — Gary D Urbiel Goldner
(74) *Attorney, Agent, or Firm* — Blank Rome LLP

(57) ABSTRACT

An exercise method and an exercise device providing rebounding for the lower body, punching bag training for the upper body, and a combination of the two, with additional optional devices. The exercise device includes a rebounding device having a rebounding surface and a housing, a frame about the rebounding device having a support member extending horizontally above the rebounding device, and at least three double-ended punching bags. The punching bags can be positioned in a triangular configuration, as viewed from above. The exercise method includes positioning oneself between the three punching bags, bouncing on the rebounding device while punching the punching bags, and shuffling on the rebounding device to avoid being hit by one or more of the punching bags rebounding from being punched. While shuffling on the rebounding device to avoid being hit by a rebounding punching bag, a user continues to punch the punching bags.

18 Claims, 4 Drawing Sheets

(58) Field of Classification Search
CPC ... A63B 26/00; A63B 26/003; A63B 69/0028; A63B 69/0035; A63B 69/004; A63B 69/0079; A63B 69/0084; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2208/02; A63B 2208/0204; A63B 2208/0209; A63B 2244/10; A63B 2244/102; A63B 2244/104; A63B 2244/106; A63B 2244/108
See application file for complete search history.

(56) References Cited

U.S. PATENT DOCUMENTS 3,547,437 A * 12/1970 Andersen ..... A63B 69/0079 473/427
4,477,083 A * 10/1984 Sowards ..... A63B 5/11 473/423
4,557,478 A * 12/1985 Levine ..... A63B 69/201 482/89
5,607,377 A * 3/1997 Wilkinson ..... A63B 5/11 482/27
5,863,278 A * 1/1999 Chen ..... A63B 69/20 482/83
7,927,260 B1 * 4/2011 Stalka ..... A63B 69/206 482/83
8,033,963 B1 * 10/2011 Jones ..... A63B 21/154 482/100
8,790,198 B1 * 7/2014 Russell ..... A63B 69/345 473/422
9,056,235 B1 * 6/2015 Mortland ..... A63B 69/24
2005/0227825 A1 * 10/2005 Kutov ..... A63B 69/205 482/83
2006/0194675 A1 * 8/2006 Valentine ..... A63B 69/201 482/83
2008/0227605 A1 * 9/2008 Issak ..... A63B 69/24 482/83
2010/0087296 A1 * 4/2010 Hansen ..... A63B 69/205 482/83
2010/0130333 A1 * 5/2010 Strong ..... A63B 69/004 482/83
2010/0227743 A1 * 9/2010 Jutte ..... A63B 21/16 482/87
2010/0248908 A1 * 9/2010 Ramsay-Matthews ..... A63B 69/004 482/89
2011/0059816 A1 * 3/2011 Campanaro ..... A63B 65/06 473/435
2012/0252637 A1 * 10/2012 Pellot ..... A63B 69/20 482/89
2013/0023359 A1 * 1/2013 Goodman ..... A63B 69/0071 473/434
2013/0065735 A1 * 3/2013 Conarty ..... A63B 69/20 482/89
2013/0210590 A1 * 8/2013 Publicover ..... A63B 5/11 482/110
2014/0121083 A1 * 5/2014 Pierce ..... A63B 9/00 482/143
2016/0256722 A1 * 9/2016 Tsai ..... A63B 5/11

* cited by examiner

POWER JUMP EXERCISE EQUIPMENT

RELATED APPLICATION

This application claims benefit of priority of U.S. Provisional Application No. 62/188,794, filed Jul. 6, 2015, entitled "Power Jump Exercise Equipment." The above-identified related application is incorporated herein by reference.

FIELD OF THE INVENTION

The present invention relates generally to work-out methods and apparatus directed to stamina, endurance, coordination, balance, speed and power; and more particularly to boxing and mixed martial arts training.

BACKGROUND OF THE INVENTION

Although work-out regimens and exercise equipment are popular and widely available, very few offer both upper and lower body conditioning, simultaneous aerobic and anaerobic training, and fewer offer mixed activity for muscle confusion (i.e., providing varied muscle stress over time, by varying exercise, sets, repetitions and resistance, to avoid muscle accommodation. The present invention provides rebounding for the lower body, punching bag training for the upper body, and a combination of the two, with additional optional devices, to add coordination, balance and agility to an otherwise directed speed, power and endurance work-out.

SUMMARY OF THE INVENTION

The present invention provides methods and apparatus that provides rebounding for the lower body, punching bag training for the upper body, and a combination of the two, with additional optional devices, to add coordination, balance and agility to an otherwise directed speed, power and endurance work-out.

The present invention includes various embodiments. In at least one embodiment, an exercise device comprises a rebounding device having a rebounding surface and a housing, a frame about the rebounding device having a support member extending horizontally above the rebounding device, and at least three double-ended punching bags. The punching bags can be positioned in a triangular configuration, as viewed from above.

In one aspect, each of the three double-ended punching bags is attached to the support member above by a vertical flexible band, and each is attached by a similar vertical flexible band to the housing, to the frame, or to a ground anchor below. The triangular configuration can be in an isosceles, equilateral or scalene configuration. Further, the rebounding device and the support member can also be of triangular configuration.

In another aspect, an apex of the triangle formed by the punching bags lies over, in a vertical plane, an apex of the triangle formed by the rebounding device. Further, where the support member is also of triangular configuration, an apex of the triangle formed by the punching bags lies under, in a vertical plane, an apex of the triangle formed by the support member.

In still another aspect, two sides of the triangle formed by the punching bags lies over, in a vertical plane, two sides of the triangle formed by the rebounding device. Further, where the support member is also of triangular configuration, two sides of the triangle formed by the punching bags lies under, in a vertical plane, two sides of the triangle formed by the rebounding device. Still further, the two sides of the triangle formed by the punching bags are shorter in length than the two sides of the triangle formed by the rebounding device, and are shorter in length than the two sides of the triangle formed by the support member.

The exercise device can further include a pendulum, hanging from the support member and positioned between the three punching bags; can further include weighted gloves, with optional resistance provided by flexible glove bands; and can further include a medicine ball, with optional resistance provided by a flexible medicine ball band.

A method of exercising using an exercise device is also provided, where the exercise device comprises a rebounding device having a rebounding surface and a housing, a frame about the rebounding device having a support member extending horizontally above the rebounding device, and at least three double-ended punching bags, where the three double-ended punching bags are positioned in a triangular configuration, as viewed from above. The exercise method comprises the steps of positioning oneself between the three punching bags, bouncing on the rebounding device while punching the punching bags, and shuffling on the rebounding device to avoid being hit by one or more of the punching bags rebounding from being punched. While shuffling on the rebounding device to avoid being hit by a rebounding punching bag, a user continues to punch the punching bags and/or bounce on the rebounding device.

Where the exercise device further comprises a pendulum, hanging from the support member and positioned between the three punching bags, the exercise method further comprise the step of ducking under and moving around the pendulum while avoiding being hit by a rebounding punching bag, and while punching the punching bags and/or bouncing on the rebounding device.

BRIEF DESCRIPTION OF THE ILLUSTRATED EMBODIMENTS

The present invention will be better understood with reference to the following description taken in combination with the drawings. For the purpose of illustration, there are shown in the drawings certain embodiments of the present invention. In the drawings, like numerals indicate like elements throughout. It should be understood, however, that the invention is not limited to the precise arrangements, dimensions, and instruments shown:

DETAILED DESCRIPTION OF THE ILLUSTRATED EMBODIMENTS

The device of the present invention provides rebounding for the lower body, punching bag training for the upper body, and a combination of the two, with additional optional devices, to add coordination, balance and agility to an otherwise directed speed, power and endurance work-out. The rebounding device could be a spring board or trampoline. The punching bags could be heavy or preferably speed bags, and more preferably double-ended single or double bags.

Figure 1:
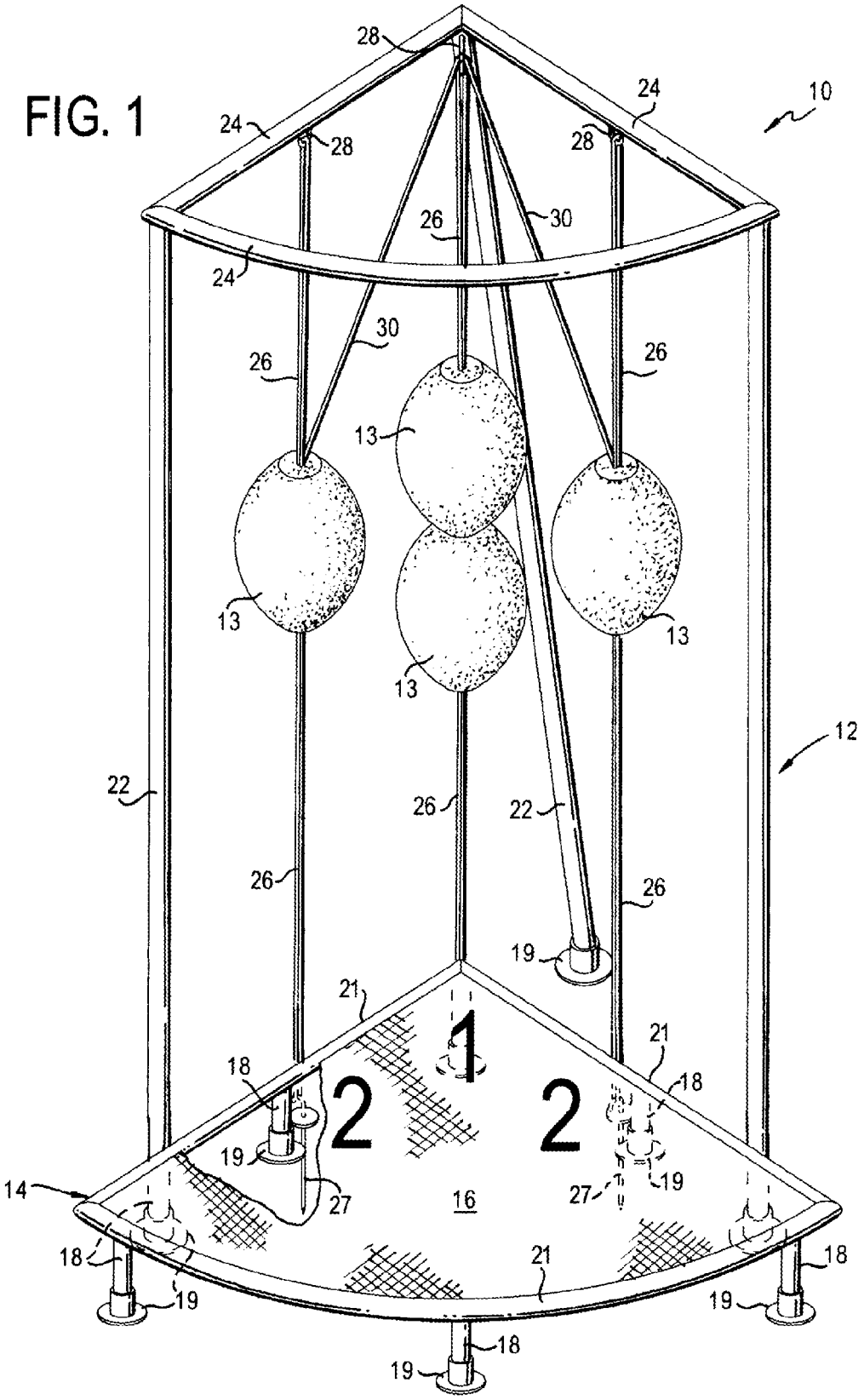
FIG. 1 illustrates an elevation view of a power jump exercise equipment device in accordance with one embodiment of the present invention.
Figure 2:
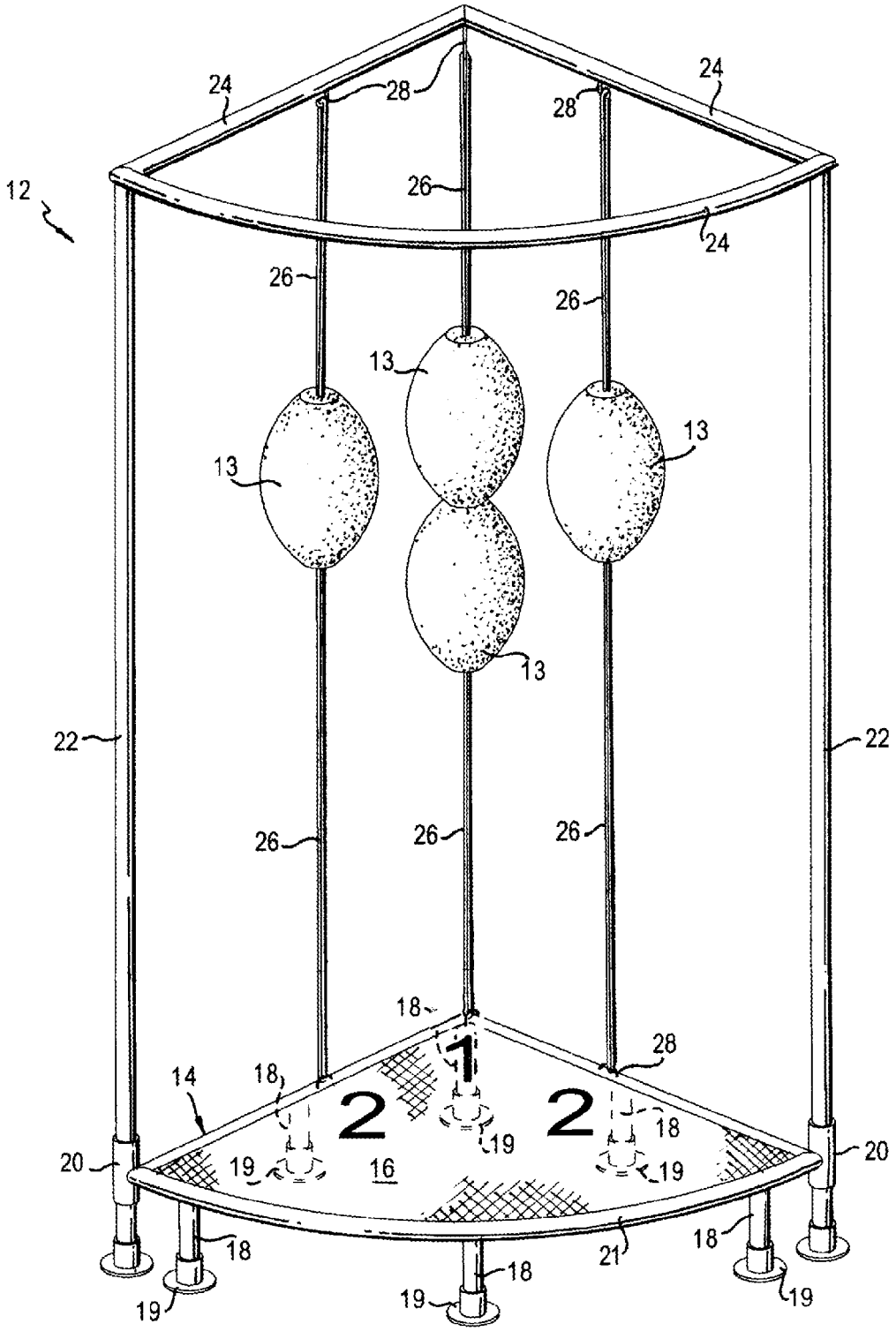
FIG. 2 illustrates a top perspective view of a second embodiment of a power jump exercise equipment device of the present invention.
Figure 3:
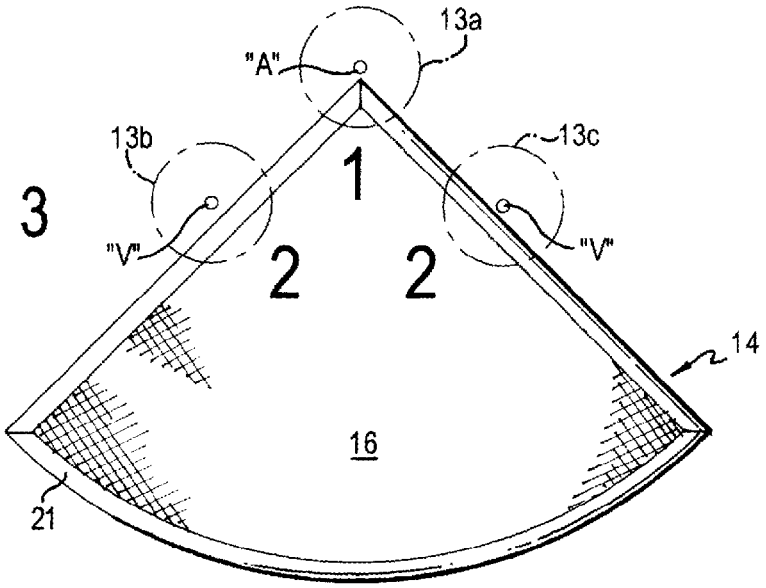
FIG. 3 illustrates a top view of the power jump exercise equipment device of FIG. 2.
Figure 4:
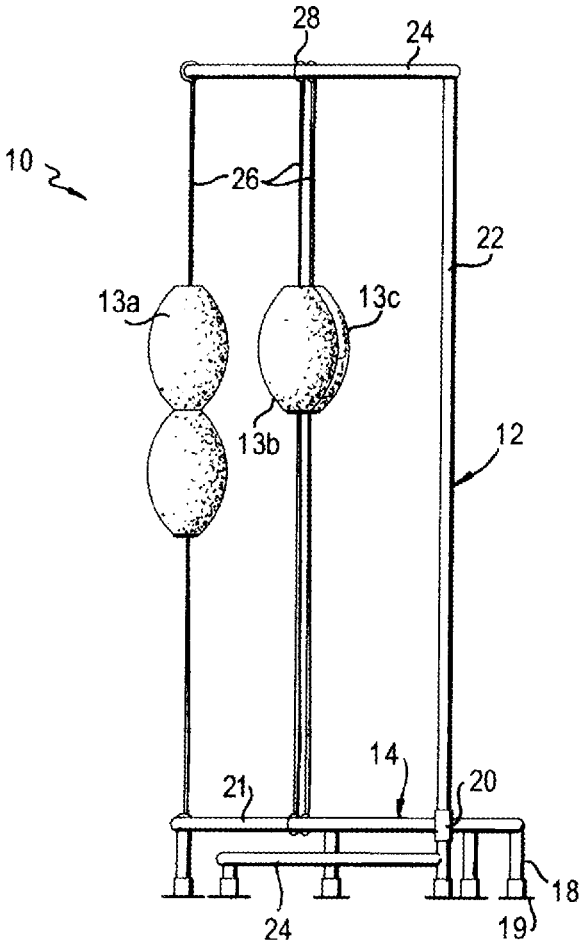
FIG. 4 illustrates a side view of a third embodiment of a power jump exercise equipment device of the present invention.

FIG. 1 illustrates an elevation view of one embodiment of a power jump exercise equipment device 10 of the present invention. The device 10 includes, generally, a frame or stand 12, multiple punching bags 13, and a rebounder 14.

The rebounder 14 can be a trampoline, mini-trampoline, or spring board, having a rebounding surface 16. FIGS. 1-5 illustrate the rebounder 14 as a mini-trampoline. The rebounder 14 can be any shape (circular, semi-circular, square, rectangular), but is preferably triangular. The rebounder 14 has legs 18 that could be adjustable. The legs 18 can be made of a tubular material. To be adjustable, the legs 18 could have an inner shaft and an outer shaft of varied diameter to provide adjustability—with a series of aligned holes with through pin placement. The legs 18 could also have feet 19 at a bottom thereof, adding stability to the rebounder 14. The feet 19 could be made of any material, such as non-slip plastic or rubber. In one aspect, the frame 12 can have similarly designed legs 18 and feet 19.

The rebounder 14 could be fixed to the frame 12, or the frame 12 or rebounder 14 could have a sleeve 20 for attaching the frame 12 to the rebounder 14. The frame 12, sleeve 20 and rebounder housing 21 could be made of any durable material, such as a metal (e.g., aluminum, steel or stainless steel) or if applicable, a plastic (e.g., polyvinylchloride "PVC"). It is not necessary that the frame 12 be connected to the rebounder 14, but in many instances, fixed attachment provides greater stability to the entire device 10 during use.

The frame 12 is positioned about (around, over and perhaps also under) the rebounder 14. The frame 12 must be configured to positionally support multiple punching bags 13. In certain embodiments, the frame 12 must be configured to support three, double-ended punching bags 13 positioned in a triangular configuration (as viewed from the top). The triangular configuration could be equilateral, isosceles or scalene. In one aspect, the triangular configuration is isosceles—either acute, right or obtuse. See FIG. 3.

In certain embodiments, as viewed from the top, the rebounder 14 is also of triangular configuration, and could be a triangle similar to that of punching bag triangle configuration, where an apex of the triangle formed by the punching bags is shared (in a vertical plane) with the triangle formed by the rebounder. In certain embodiments, the sides of the triangle, meeting at the apex, of the punching bag triangle is located over (in a vertical plane) the sides of the triangle of the rebounder. In this instance, the sides of the triangle of the rebounder, meeting at the apex, are longer than those of the punching bag triangle (in certain instances, twice as long). During use, an individual can be centrally positioned on the rebounder within the three, double-ended punching bags.

Figure 5:
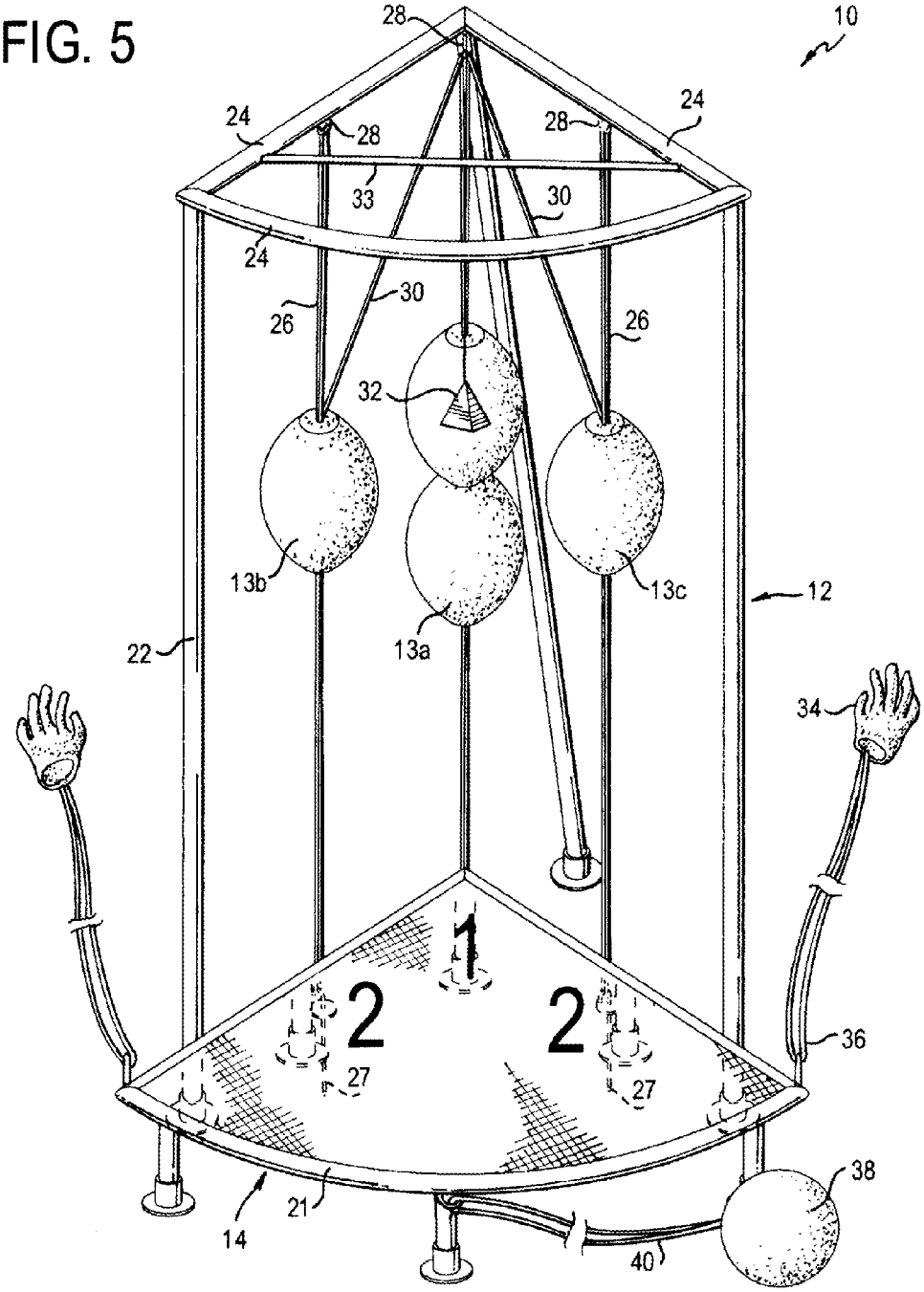
FIG. 5 illustrates an elevation view of a fourth embodiment of a power jump exercise equipment device of the present invention.

Accordingly, the frame 12 includes necessary vertical members 22 and horizontal members 24 to facilitate the above-described punching bag configuration, while supporting such configuration without obstacle to free movement of the punching bags, and associated flexible bands, during use of the device 10. FIGS. 1-5 illustrates frame 12 arrangements where vertical 22 and horizontal 24 members are arranged to provide free movement of the three punching bags 13. Note that no vertical member 22 is positioned to conflict with movement of the three punching bags 13. To avoid such conflict, one or more of the vertical members, if necessary to ensure frame integrity, could be diagonally offset (as shown in FIGS. 1 and 5).

In FIGS. 1-5 (see, particularly, FIG. 3), one double, double-ended punching bag 13*a*, is located at apex "A" of a punching bag 13 triangle configuration. Two single, double-ended punching bags 13*b*, 13*c*, are located at respective vertexes "V" of the punching bag 13 triangle configuration. Each punching bag 13*a*, 13*b*, 13*c*, has vertical flexible bands 26, attached top and bottom thereto, to tightly connect each punching bag 13*a*, 13*b*, 13*c*, to an above horizontal member 24 of the frame 12, and below to either the rebounder housing 21, a horizontal member 24 of the frame 12, or to a fixed ground anchor 27. For best use, the flexible bands must be taught, so a preferable arrangement is to use vertical flexible bands 26. Vertical flexible bands 26 also provide for freer horizontal movement of the punching bags 13, where horizontal reflex movement of the punching bags, after contact, adds to the exercise experience by challenging user coordination, balance and speed, to avoid being hit by a rebounding punching bag 13.

Vertical members 22 of the frame 12 could be adjustable, similar to that described for the legs (with inner and outer telescoping members), to set the frame 12 at a desired height. Note that adjustment of frame 12 height is not necessary to adjust punching bag 13 height, as respective top and bottom vertical flexible bands 26 can be re-strung to adjust punching bag 13 height. Alternatively, the punching bags 13 could be any available commercial punching bag, speed bag, or exercise ball. Preferably double-ended, the punching bags 13 are attached to (or come attached to) one end of a flexible band 26 (and preferably one end of two flexible bands 26), with the other end of the flexible bands 26 attached to a fastener 28, such as a commercial ring, eyelet, hook, D-clamp, mounted to the frame 12, to the rebounder housing 21, and/or a ground anchor 27. The flexible bands 26 could be releasably attached to the fasteners 28 so that the tension of the bands 26 could be adjusted to desired tension. In one aspect, the position of the punching bags 13, and degree of band tautness, is adjusted depending on how the bands 26 are attached. In another aspect, to increase tautness of the flexible bands 26, and respective action of the punching bags 13, additional diagonal flexible bands 30 can be implemented. For example, in FIGS. 1 and 5, additional diagonal flexible bands 30 are attached to the fastener 28 above the one, double ball, double-ended punching bag 13*a*, where one additional diagonal flexible band 30 extends to each of a top of the single ball, double-ended punching bags 13*b*, 13*c*.

As noted, the punching bags 13 can be adjustable in height (z-axis), whether by frame 12 adjustment or flexible band 26 adjustment. The punching bags 13 can also be adjustable horizontally (x and y axes), such as back-and-forth and side-to-side. The rebounder housing 21 could be padded (not shown), where the padding can assist injury prevention due to user falling on the rebounder housing 21 rather than on the rebounding surface 16. The padding can be made of a soft, resilient material, such as foam or rubber. To further prevent injury, and/or provide additional exercise challenge, the rebounder 14 can extend laterally beyond a vertical plane of the punching bags 13*a*, 13*b*, 13*c*, in any or all direction, where the flexible band 26 of the respective punching bags 13*a*, 13*b*, 13*c*, pass through a formed aperture in the rebounding surface 16 and are secured below to a horizontal member 24 of the frame 12 or to a ground anchor 27.

The present invention also involves a method of exercising, using the power jump exercise equipment device 10 detailed above. The user may jump, shuffle, bounce and move, on the rebounder 14, exercising the lower body, while punching one or all of the punching bags 13. Depending on user fitness, any level of work-out, or challenge, can be obtained based upon user action. For example, as the user punches one or more of the bags, the user must thereafter shuffle to avoid being hit by a rebounding bag, until the rebounding bag substantially settles. The continual bouncing, hitting, and shuffling to avoid being hit, provides an aerobic and anaerobic experience realistic of training for a boxing or mixed martial arts competition. The level of challenge is dictated by user capability.

On the rebounding surface 16, there could be placed markers, such as the "1" and "2" shown in FIGS. 1, 2, 3 and 5. Here, the user can place a lead left foot, or lead right foot, on marker "1", with back foot on one of markers "2". The user can then train for alternative boxing styles, working right-hand and left-hand leading activity.

Additionally, in an alternative embodiment, a pendulum 32 can be hung in a location generally central to (within, between) the three punching bags 13, preferably chest to shoulder height. Depending on desired placement of the pendulum 32, or of any other peripheral accessory, one or more crossbar(s) 33 may be included between the horizontal frame members 24 for convenient hanging of the pendulum 32 or other accessory. While the user bounces on the rebounder 14, hits the punching bags 13, shuffles to avoid being hit by the rebounding punching bags 13, the user can further duck and move around the dangling pendulum 32 to challenge trunk movement, provide oblique exercise, and further enhance reflex and focus.

Further, weighted gloves 34 (weights optional) can be provided with glove bands 36 attached thereto, and further attached to either the rebounder housing 21 or the frame 12. Performing the above-described work-out, while using the weighted gloves 34 with glove band 36 resistance, provides increased challenge and exercise enhancement. Still further, pre- or post-workout warm-up and stretching can be performed on the rebounding surface 16, while standing, sitting or lying thereon, with a medicine ball 38 of varying weight or texture, where the medicine ball 38 can also include medicine ball bands 40, again attached to either the rebounder housing 21 or the frame 12, to enhance the exercise experience.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. For example, features detailed as included in certain specific embodiments above are recognized as interchangeable and possibly included in other detailed embodiments. Specific dimensions of any particular embodiment are described for illustration purposes only. It should therefore be understood that this invention is not limited to the particular embodiments described herein, but is intended to include all changes and modifications that are within the scope and spirit of the invention.

What is claimed is:

1. An exercise device comprising:

a rebounding device having a rebounding surface and a housing;

a frame about the rebounding device having a support member extending horizontally above the rebounding device;

three double-ended punching bags; and a pendulum;

wherein the three double-ended punching bags are positioned in a triangular configuration, as viewed from above, and the pendulum hangs from the support member and is positioned between the three punching bags.

2. The exercise device of claim 1, wherein each of the three double-ended punching bags is attached to the support member above by a vertical flexible band, and each is attached by a similar vertical flexible band to the housing of the rebounding device, to the frame about the rebounding device, or to a ground anchor below the rebounding surface.

3. The exercise device of claim 1, wherein the triangular configuration is an isosceles triangular configuration.

4. The exercise device of claim 1, wherein the rebounding device is also of triangular configuration.

5. The exercise device of claim 4, wherein the support member is also of triangular configuration.

6. The exercise device of claim 1, wherein each of the three double-ended punching bags is configured to move independently relative to each of the other double-ended punching bags.

7. The exercise device of claim 1, wherein the three double-ended punching bags positioned in the triangular configuration are configured to provide that the user can be positioned between the three double-ended punching bags while the user is on the rebounding surface during an entirety of use with the exercise device.

8. The exercise device of claim 1, wherein:

the frame about the rebounding device includes a vertical member; and the support member extending horizontally above the rebounding device is attached to the vertical member and includes a horizontal component configured to provide three fasteners or fastener positions, fixed relative to one another, forming the triangular configuration, for respective connection to each of the three double-ended punching bags.

9. The exercise device of claim 8, wherein each of the three double-ended punching bags is attached below to the housing of the rebounding device, to the frame about the rebounding device, or to a ground anchor below the rebounding surface, the respective attachment below to the housing of the rebounding device, to the frame about the rebounding device, or to the ground anchor below the rebounding surface, is directly vertically below the respective connection to the respective fastener or fastener position of the horizontal component.

10. An exercise device comprising:

a rebounding device having a rebounding surface and a housing;

a frame about the rebounding device having a support member extending horizontally above the rebounding device; and three double-ended punching bags;

wherein the three double-ended punching bags are positioned in a triangular configuration, as viewed from above, the rebounding device is of triangular configuration, and an apex of the triangular configuration formed by the punching bags lies over, in a vertical plane, an apex of the triangular configuration formed by the rebounding device.

11. The exercise device of claim 10, wherein the support member is also of triangular configuration, and wherein the apex of the triangular configuration formed by the punching bags lies under, in the vertical plane, an apex of the triangular configuration formed by the support member.

12. An exercise device comprising:

a rebounding device having a rebounding surface and a housing;

a frame about the rebounding device having a support member extending horizontally above the rebounding device, and three double-ended punching bags;

wherein the three double-ended punching bags are positioned in a triangular configuration, as viewed from above, the rebounding device is of triangular configuration, and two sides of the triangular configuration formed by the punching bags lie over, in a vertical plane, two sides of the triangular configuration formed by the rebounding device.

13. The exercise device of claim 12, wherein the support member is also of triangular configuration, and wherein the two sides of the triangular configuration formed by the punching bags lie under, in the vertical plane, two sides of the triangular configuration formed by the support member.

14. The exercise device of claim 13, wherein the two sides of the triangular configuration formed by the punching bags are shorter in length than the two sides of the triangular configuration formed by the rebounding device, and are shorter in length than the two sides of the triangular configuration formed by the support member.

15. A method of exercising using an exercise device, where the exercise device comprises:

a rebounding device having a rebounding surface and a housing;

a frame about the rebounding device having a support member extending horizontally above the rebounding device;

three double-ended punching bags, where the three double-ended punching bags are positioned in a triangular configuration, as viewed from above; and a pendulum, hanging from the support member and positioned between the three punching bags;

the method comprising the steps of:

a user positioning oneself between the three punching bags;

the user bouncing on the rebounding device while punching the punching bags;

the user shuffling on the rebounding device to avoid being hit by one or more of the punching bags rebounding from being punched, wherein, while shuffling on the rebounding device to avoid being hit by a rebounding punching bag, continuing to punch the punching bags; and the user ducking under and moving around the pendulum while avoiding being hit by a rebounding punching bag, while punching the punching bags.

16. The method of claim 15, wherein each of the three double-ended punching bags is configured to move independently relative to each of the other double-ended punching bags.

17. The method of claim 15, wherein the three double-ended punching bags positioned in the triangular configuration are configured to provide that the user can be positioned between the three double-ended punching bags while the user is on the rebounding surface during an entirety of use with the exercise device.

18. The method of claim 15, wherein:

the frame about the rebounding device includes a vertical member; and the support member extending horizontally above the rebounding device is attached to the vertical member and includes a horizontal component configured to provide three fasteners or fastener positions, fixed relative to one another, forming the triangular configuration, for respective connection to each of the three double-ended punching bags.

* * * * *